US008776450B2

(12) United States Patent
Lee

(10) Patent No.: US 8,776,450 B2
(45) Date of Patent: Jul. 15, 2014

(54) BUILDING ROOF STRUCTURE

(71) Applicant: Men-Chyan Lee, New Taipei (TW)

(72) Inventor: Men-Chyan Lee, New Taipei (TW)

( * ) Notice: Subject to any disclaimer, the term of this patent is extended or adjusted under 35 U.S.C. 154(b) by 0 days.

(21) Appl. No.: 13/958,326

(22) Filed: Aug. 2, 2013

(65) Prior Publication Data

US 2014/0053482 A1 Feb. 27, 2014

(30) Foreign Application Priority Data

Aug. 23, 2012 (TW) ..... 101216266 U

(51) Int. Cl.
*E04D 13/17* (2006.01)

(52) U.S. Cl.
USPC ..... 52/95; 52/96; 52/198; 52/302.4; 362/145; 239/108; 454/242; 454/260

(58) Field of Classification Search
USPC ..... 52/95–97, 198, 199, 302.4; 62/259.4; 454/242, 260, 364–367; 239/108; 362/145; 165/48.1
See application file for complete search history.

(56) References Cited

U.S. PATENT DOCUMENTS

| | | | | | |
|---|---|---|---|---|---|
| 27,872 | A | * | 4/1860 | Walcott | 52/302.3 |
| 1,831,880 | A | * | 11/1931 | Pierce | 169/16 |
| 2,512,550 | A | * | 6/1950 | Pezzano | 52/584.1 |
| 3,619,961 | A | * | 11/1971 | Sterrett | 52/302.1 |
| 3,683,785 | A | * | 8/1972 | Grange | 454/250 |
| 4,175,703 | A | * | 11/1979 | Valiant | 239/208 |
| 4,214,408 | A | * | 7/1980 | Rich, Jr. | 52/79.1 |
| 4,372,493 | A | * | 2/1983 | Smith | 239/208 |
| 4,441,295 | A | * | 4/1984 | Kelly | 52/408 |
| 4,635,419 | A | * | 1/1987 | Forrest | 52/302.3 |
| 4,707,961 | A | * | 11/1987 | Nunley et al. | 52/408 |
| 4,736,561 | A | * | 4/1988 | Lehr et al. | 52/410 |
| 4,761,965 | A | * | 8/1988 | Viner | 62/171 |
| 4,852,314 | A | * | 8/1989 | Moore, Jr. | 52/199 |
| 4,937,990 | A | * | 7/1990 | Paquette | 52/199 |
| 4,977,714 | A | * | 12/1990 | Gregory, Jr. | 52/95 |
| 5,069,950 | A | * | 12/1991 | Crookston, Sr. | 428/156 |
| 5,088,259 | A | * | 2/1992 | Myers | 52/410 |
| 5,263,543 | A | * | 11/1993 | Nigro | 169/56 |
| 5,433,050 | A | * | 7/1995 | Wilson et al. | 52/302.1 |
| 5,473,847 | A | * | 12/1995 | Crookston | 52/302.1 |
| 5,487,247 | A | * | 1/1996 | Pigg | 52/302.3 |
| 5,636,481 | A | * | 6/1997 | De Zen | 52/95 |
| 5,732,511 | A | * | 3/1998 | Scott | 52/1 |
| 6,061,973 | A | * | 5/2000 | Accardi et al. | 52/90.1 |
| 6,092,344 | A | * | 7/2000 | Kelly | 52/410 |

(Continued)

FOREIGN PATENT DOCUMENTS

WO 2009/151307 A1 * 12/2009

*Primary Examiner* — Robert Canfield
(74) *Attorney, Agent, or Firm* — Muncy, Geissler, Olds & Lowe, P.C.

(57) ABSTRACT

The present invention discloses a building roof structure formed by a skeleton, hollow assemblies, a waterproof layer and a heat insulation plate. The hollow assemblies are installed on the skeleton, the waterproof layer is paved on the hollow assemblies and the heat insulation plate is disposed above the waterproof layer. Hot air rising up inside the building and heat accumulated on the roof by being exposed to sun can all be circulated out through cooling spaces formed by the hollow assemblies, which achieves the cooling effect of natural air circulation to reduce temperature inside the building without using external fans or air drafting equipment. Therefore, the green building concept that saves energy and reduces $CO_2$ emission is complied with, thereby improving the living quality of building.

13 Claims, 9 Drawing Sheets

(56) References Cited

U.S. PATENT DOCUMENTS

| | | | | |
|---|---|---|---|---|
| 6,363,662 | B1 * | 4/2002 | Coates | 52/12 |
| 6,401,412 | B1 * | 6/2002 | Cooper | 52/302.1 |
| 6,450,264 | B1 * | 9/2002 | Christian | 169/16 |
| 6,732,951 | B1 * | 5/2004 | Salazar et al. | 239/209 |
| 6,780,099 | B1 * | 8/2004 | Harper | 454/186 |
| 6,941,706 | B2 * | 9/2005 | Austin et al. | 52/94 |
| 6,968,651 | B2 * | 11/2005 | Bergeron | 52/12 |
| 7,818,922 | B2 * | 10/2010 | Ellis | 52/95 |
| 8,136,319 | B2 * | 3/2012 | Kelly | 52/409 |
| 8,281,522 | B1 * | 10/2012 | Hawryshko et al. | 52/95 |
| 2001/0018815 | A1 * | 9/2001 | Nunley et al. | 52/410 |
| 2003/0051419 | A1 * | 3/2003 | Suzuki | 52/90.1 |
| 2003/0126806 | A1 * | 7/2003 | Ellis | 52/95 |
| 2004/0134137 | A1 * | 7/2004 | Geer et al. | 52/95 |
| 2006/0053718 | A1 * | 3/2006 | Kelly | 52/409 |
| 2008/0163565 | A1 * | 7/2008 | Toas | 52/95 |
| 2011/0247842 | A1 * | 10/2011 | Huber | 169/54 |

* cited by examiner

BUILDING ROOF STRUCTURE

BACKGROUND OF THE INVENTION a) Field of the Invention

The present invention relates to a building roof structure, and more particularly to an air permeation roof that utilizes an effect of natural air circulation to save energy and reduce temperature inside the building and of the roof.

b) Description of the Prior Art

An ordinary tin house can be built up quickly and therefore is applied to a gathering place, a resident house, a factory, a warehouse or a market that is built temporally. However, under direct exposure to sun, temperature inside the tin house can increase quickly. Therefore, a ceiling fan will be added under the roof of the tin house to reduce primarily the temperature inside the tin house.

Nevertheless, adding the ceiling fan under the roof of the tin house is very dangerous, not implemented easily and not pretty. Furthermore, as the ceiling fan is suspended high, objects or persons underneath the ceiling fan can be injured easily if the ceiling fan drops accidentally. In addition, according to the physical phenomenon that hot air rises up and cold air descends, hot air will be concentrated at a top inside the tin house. As the ceiling fan is installed in proximity to the top inside the tin house, when the ceiling fan is turned on, hot air at the top of the tin house will be blown downward, which only results in convection of the hot air inside the tin house and allows the people inside the tin house to feel like staying in an oven, without actually expelling out the hot air.

Accordingly, there are vendors who have designed a way of adding plural rooftop ventilation fans outside the tin house to achieve the air circulation effect by connecting indoor air with outdoor air. This method utilizes primarily natural wind to drive the ventilation fans, such that an air drafting effect can be formed by the ventilation fans and hot air inside the tin house can be expelled out. Besides that, air convection can be formed inside and outside the tin house.

However, this method can only activate the ventilation fans to rotate if there is natural wind. On the contrary, if there is no natural wind, then the hot air in the tin house is still not able to be expelled out effectively and quickly. In addition, as fan blades of the ventilation fans are not the air drafting blades, the air drafting efficiency is not high.

SUMMARY OF THE INVENTION

The primary object of the present invention is to provide an air permeation roof that utilizes the effect of natural air circulation to reduce temperature inside a building and of the roof.

To achieve the abovementioned object, the present invention discloses a building roof structure including a skeleton built on a top of the building, at least a hollow assembly that is installed on the skeleton, a waterproof layer that is paved on the hollow assembly, and a heat insulation plate that is disposed above the waterproof layer.

According to an embodiment of the present invention, the hollow assembly is formed primarily by plural baffles, and the baffles form cooling spaces for air circulation, According to an embodiment of the present invention, the hollow assembly is formed primarily by plural hollow bricks with a cooling space, and the hollow bricks are arranged above the waterproof layer in an array.

According to an embodiment of the present invention, the hollow assembly is formed primarily by plural long hollow bricks with a cooling space, and the long hollow bricks are arranged side-by-side beneath the waterproof layer.

According to an embodiment of the present invention, each brick is formed with a connecting unit to combine and fix with the other brick.

According to an embodiment of the present invention, the building roof structure further includes plural isolation nets, and the isolation nets are installed at an air opening of the hollow assembly respectively.

According to an embodiment of the present invention, the heat insulation plate is a roof tile or a solar panel.

According to an embodiment of the present invention, a tail end of the heat insulation plate is installed at least with a flow deflector for guiding out rain water.

According to an embodiment of the present invention, the flow deflector is provided with plural drain holes.

According to an embodiment of the present invention, the skeleton is installed with a collecting trough that corresponds to the flow deflector and collects the rain water.

According to an embodiment of the present invention, the building roof structure includes further plural illuminating lamps disposed at a tail end of the flow deflector.

According to an embodiment of the present invention, the building roof structure includes further a ridge at a center of the roof, and the ridge is installed with a water sprinkler for sprinkling the heat insulation plate to reduce temperature thereof.

Another primary object of the present invention is to provide a building roof structure, where as there is no need to use external fans or air drafting equipment for air circulation, it is not necessary to maintain the external fans or the air drafting equipment constantly, thereby reducing the cost of related equipment.

Still another primary object of the present invention is to provide a building roof structure, where as temperature in the building is reduced using the effect of natural air circulation provided by the hollow assembly, the green building concept that saves energy and reduces $CO_2$ emission is complied with, thereby improving the living quality of the building.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
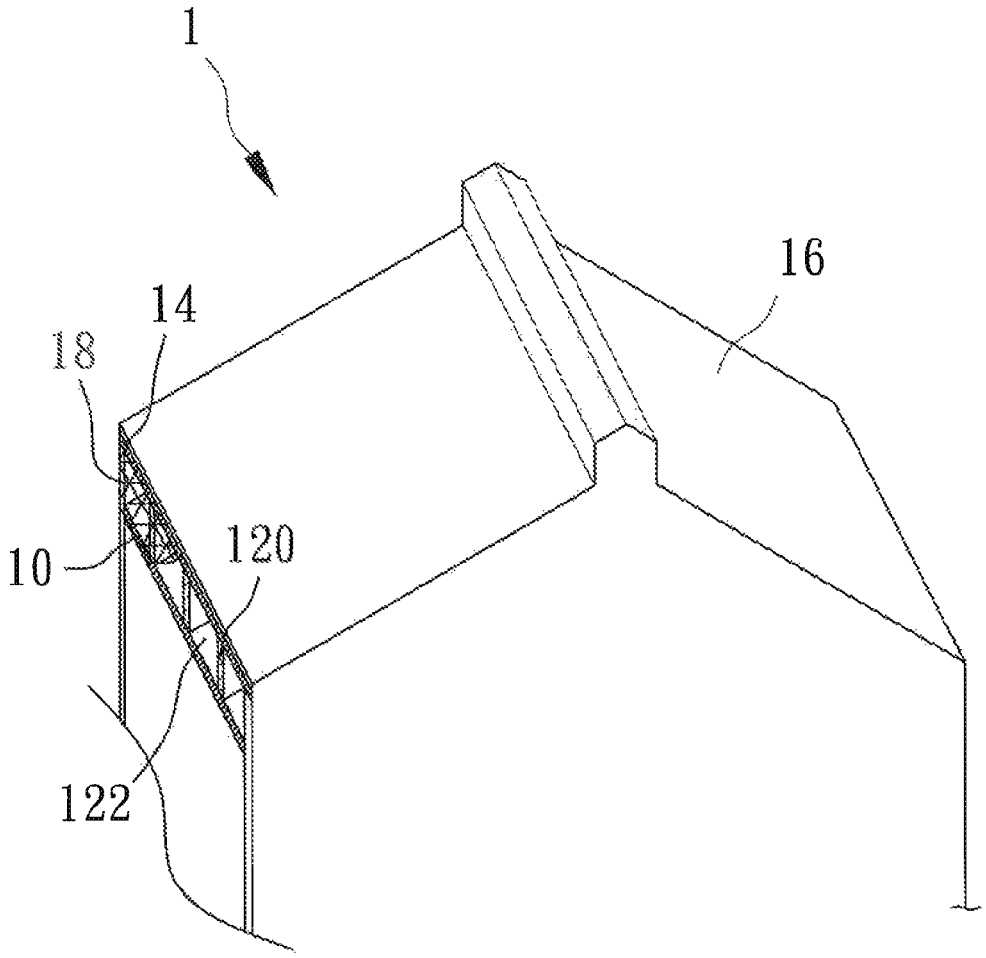
FIG. 1 shows a schematic structural view of a first embodiment of the present invention.

The description of illustrative embodiments hereinafter is intended to be easily understood by persons skilled in the art, regarding the benefits and functions of the present invention.

The structures, scales and sizes disclosed in the drawings of the specification are only used in connection with the contents disclosed in the specification to be understood and read by persons skilled in the art and are not intended in any way to limit the scope of the present invention. Any modification to the structures, change in the scales or adjustment of the sizes should still fall within the range covered by the technical means disclosed by the present invention provided that the functions and objects that can be achieved by the present invention are not affected. In addition, the relative terms such as "one," "two," "above" used in the specification are for convenience of description only and are not used to limit the range of implementation of the present invention. The change in or adjustment of the relative relationships is also considered as being within the range of implementation of the present invention, if there is no physical change in the technical means.

Figure 2:
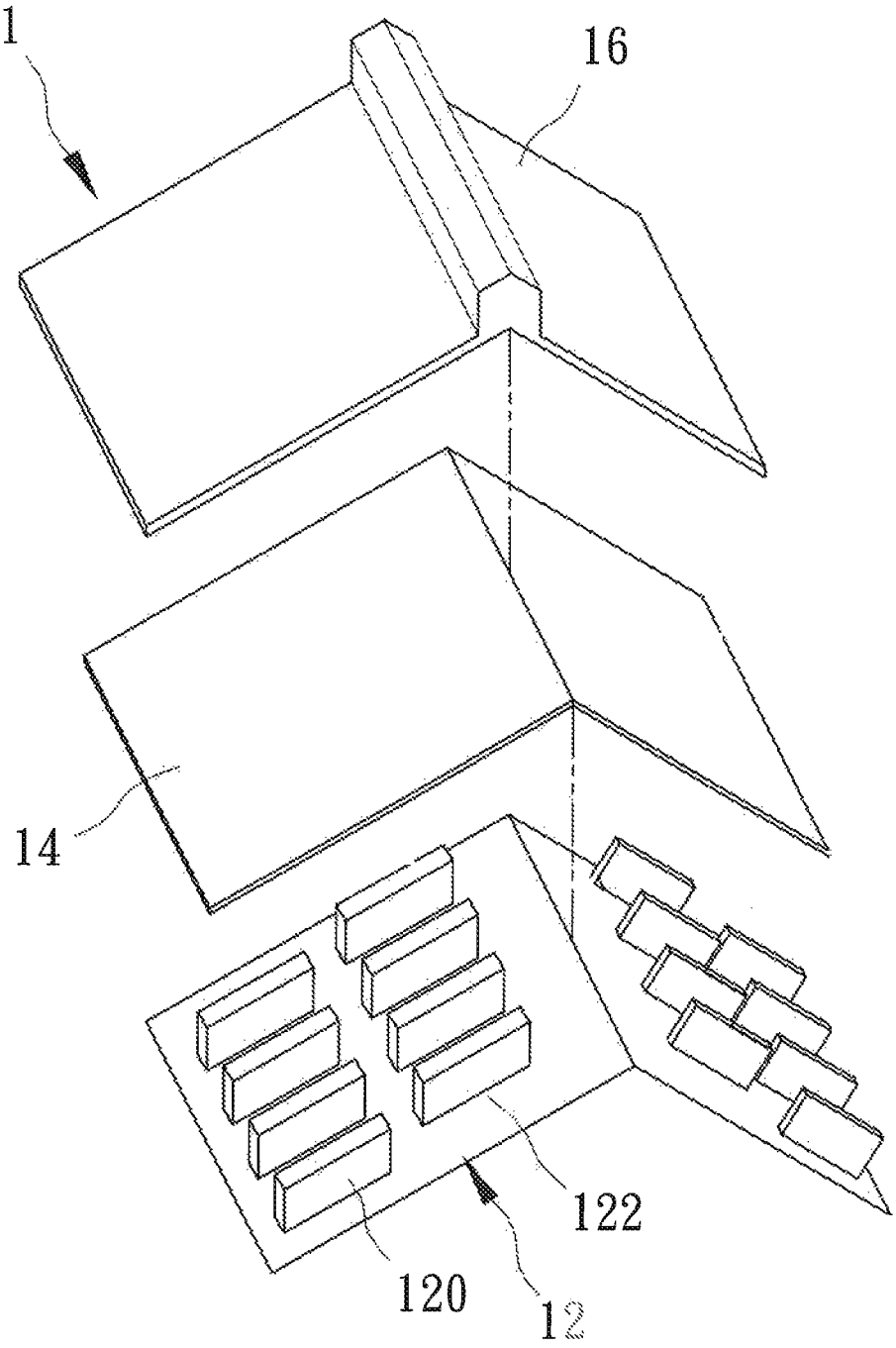
FIG. 2 shows a schematic structural view of baffles of the first embodiment of the present invention.

Referring to FIG. 1 and FIG. 2, it shows a first embodiment of the present invention. The present invention provides an air permeation roof of a building, and this air permeation roof 1 is formed primarily by a skeleton 10, hollow assemblies 12, a waterproof layer 14 and a heat insulation plate 16. The skeleton 10 is built on a top of the building and is installed with plural hollow assemblies 12. In the first embodiment, the hollow assembly 12 is formed by plural baffles 120, and the baffles 120 form plural cooling spaces 122 for air circulation. The waterproof layer 14 and the heat insulation plate 16 that are paved orderly on the hollow assembly 12 insulate primarily most of the heat energy, and also prevent from penetration of rain water or water sprinkled for reducing temperature. It is worth of mentioning that in addition to a roof tile, the heat insulation plate 16 can also utilize a solar panel that is now usually applied in a green building (in this embodiment, an ordinary roof tile is used as an example). On the other hand, as the hollow assembly 12 is formed by the baffles 120, the way of arranging the baffles 120 and the orientation thereof can be changed depending upon the actual requirement to improve the entire air convection, thereby achieving the best air circulation effect. Moreover, to avoid birds building nests in the cooling spaces 122, isolation nets 18 are installed at air openings and can also keep foreign objects from entering into the cooling spaces 122.

Figure 2A:
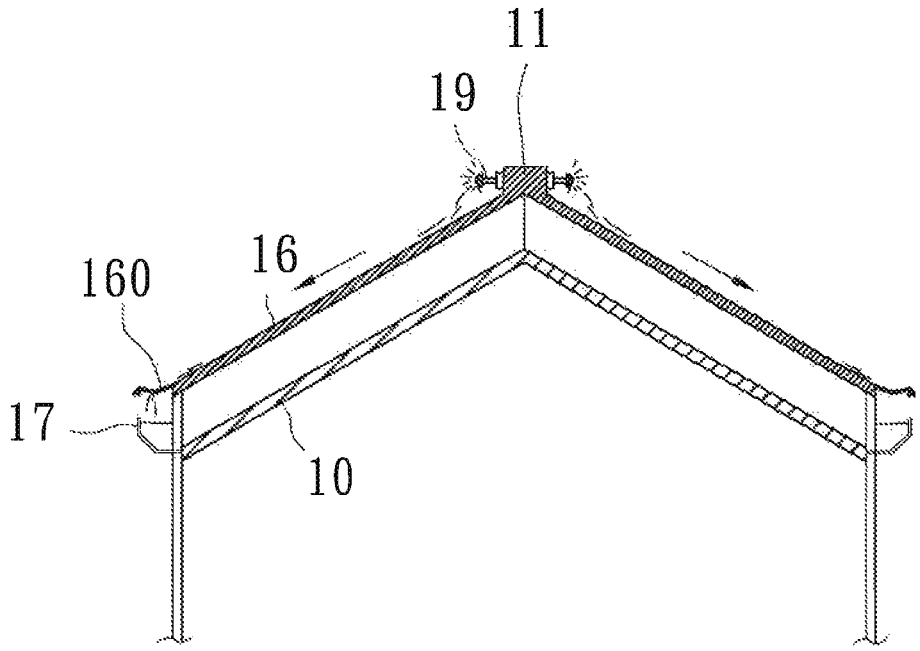
FIG. 2A shows a cutaway view of the first embodiment of the present invention that is added with a flow deflector.
Figure 2B:
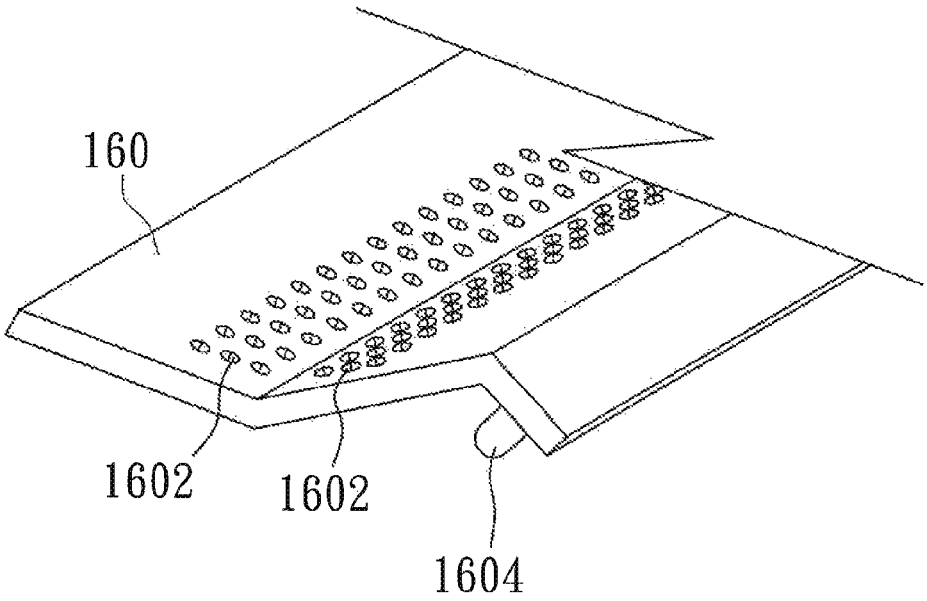
FIG. 2B shows a three-dimensional structural view of the flow deflector of the present invention.

As shown in FIG. 2A and FIG. 2B, to cope with a rainy day and avoid a problem that results from accumulation of the rain water on the roof, in this embodiment, a tail end of the heat insulation plate 16 is installed at least with a flow deflector 160. The flow deflector 160 is formed with plural drain holes 1602 to expel the rain water downward, thereby achieving the purpose of expelling water on the roof effectively. On the other hand, to achieve the purpose of recycling the water resource, the skeleton 10 is installed with a collecting trough 17 that corresponds to the flow deflector 160 and collects the rain water; whereas, the rain water in the collecting trough 17 can be stored and used to cool down the heat insulation plate 16 in the future. In order to sprinkle the rain water on the heat insulation plate 16 successfully, a center of the air permeation roof, according to the present invention, is equipped with a ridge 11; whereas, the ridge 11 is installed with a water sprinkler 19. Therefore, through the water sprinkler 19, the rain water collected can be sprinkled on the heat insulation plate 16 that results in high temperature by heat. This not only achieves the purpose of sprinkling the water to reduce temperature, but also complies with the intention of recycling the water resource, allowing the present invention to be provided with the green building concept that saves energy and reduces $CO_2$ emission. In addition to the abovementioned structures, a tail end of the flow deflector 160 can be installed with plural illuminating lamps 1604 to increase a visual sense of beauty by projecting light of the illuminating lamps 1604 on the dripping water jets.

Figure 3:
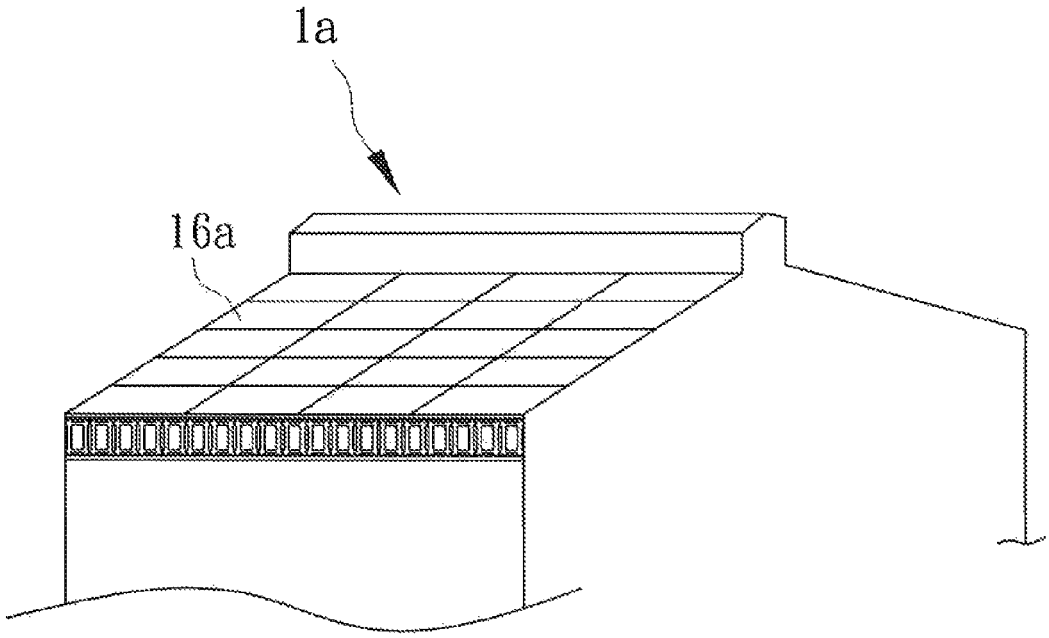
FIG. 3 shows a schematic structural view of a second embodiment of the present invention.
Figure 4:
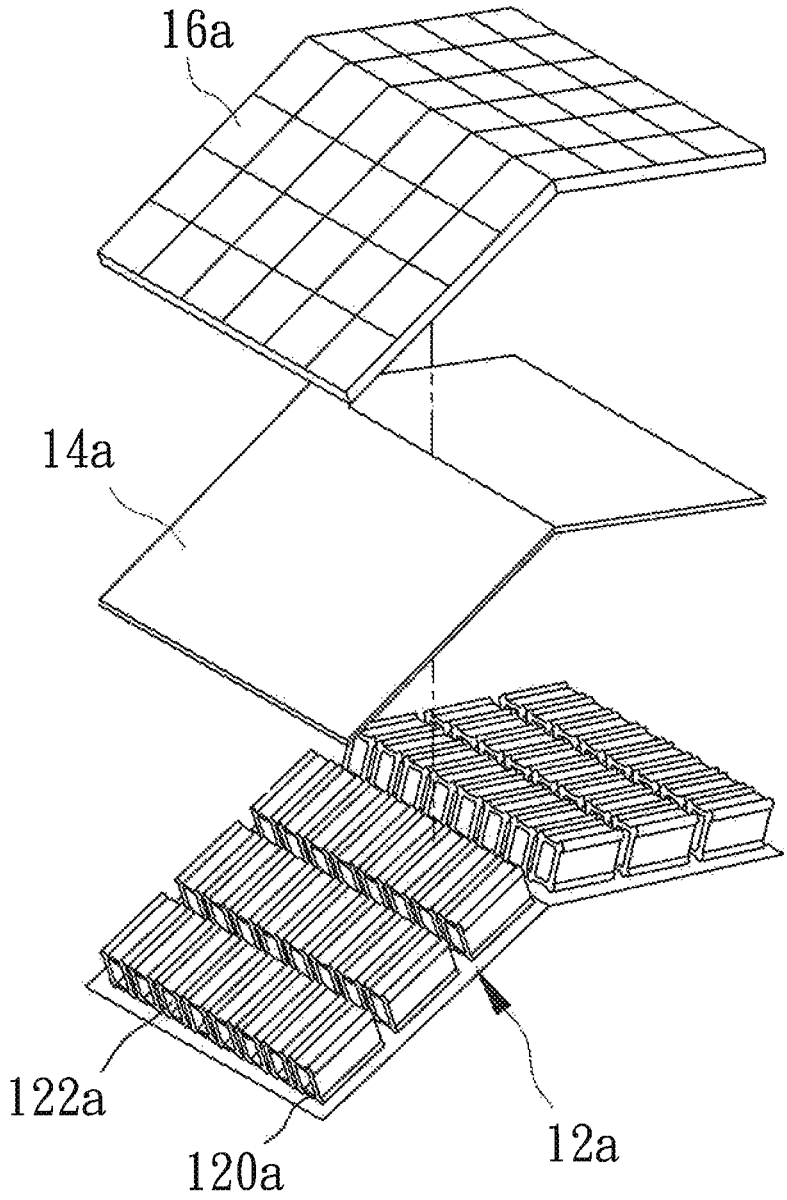
FIG. 4 shows a schematic structural view of hollow bricks of the second embodiment of the present invention.

Referring to FIG. 3 and FIG. 4, it shows a second embodiment of the present invention. The difference from the abovementioned first embodiment lies in that the hollow assembly 12*a* is formed primarily by plural hollow bricks 120*a* with a cooling space 122*a*, and the hollow bricks 120*a* are arranged beneath the waterproof layer 14*a* in an array. As the hollow bricks 120*a* can use existing specifications and products on the markets, the hollow assembly 12*a* can be formed by installing the hollow bricks 420*a* one by one directly in an array to reduce time of construction. The hollow assembly 12*a* is the same as that of the first embodiment, but the only difference is that the heat insulation plate 16*a* is a solar panel, which will not be described further.

Figure 5:
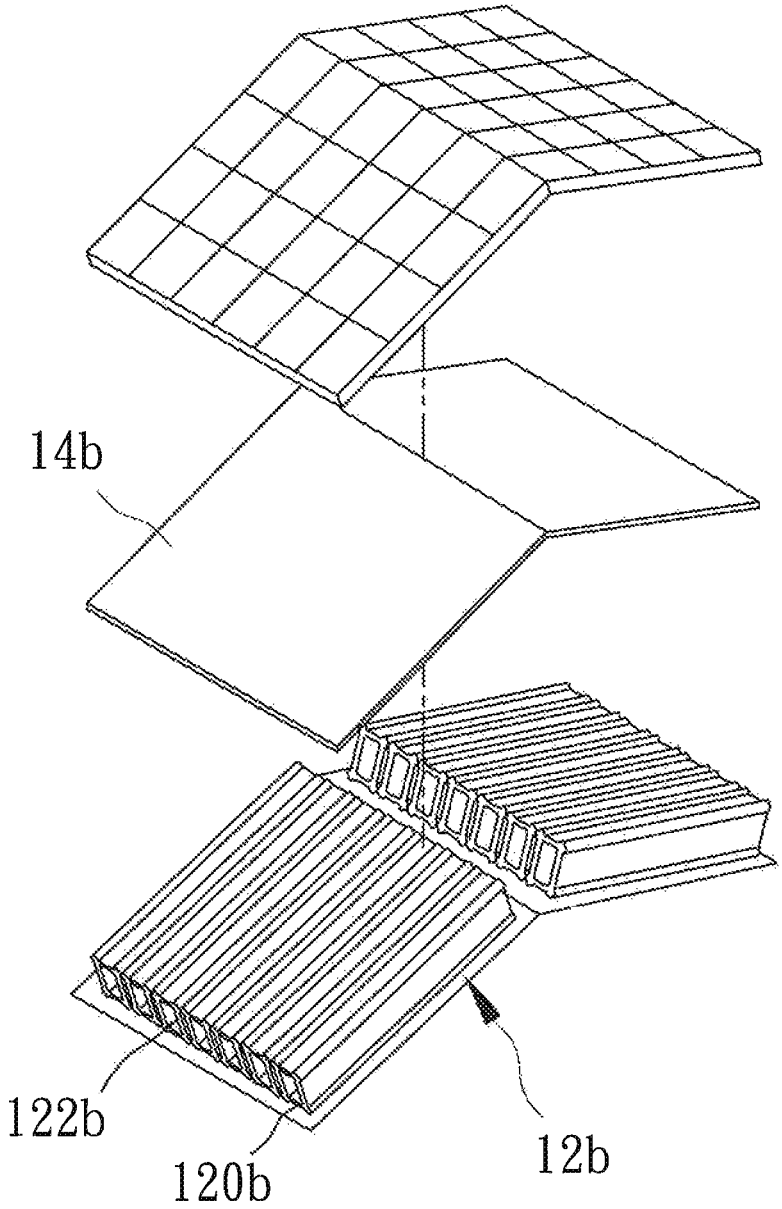
FIG. 5 shows a schematic structural view of long hollow bricks of a third embodiment of the present invention.

As shown in FIG. 5, it shows a third embodiment of the present invention, wherein the hollow assembly 12*b* is formed primarily by plural long hollow bricks 120*b* with a cooling space 122*b*, and the long hollow bricks 120*b* are arranged side-by-side above the waterproof layer 14*b*.

This kind of hollow assembly 12*b* is made specifically according to length or width of the roof and the long hollow bricks 120*b* are installed side-by-side on the roof. Therefore, the quantity of long hollow bricks 120*b* can be reduced significantly, yet still achieving the better air circulation effect. As the hollow assembly 12*b* is the same as that of the first embodiment, further description is not disclosed.

Figure 7:
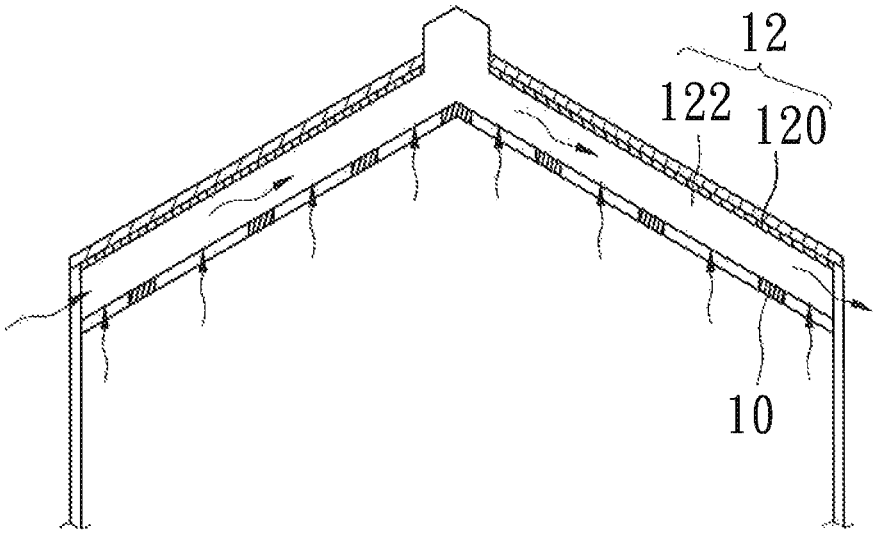
FIG. 7 shows a cutaway view of air permeation inside a building and on a roof.

In the present invention, the hollow assembly 12 is installed on the skeleton 10. However, to achieve the best indoor air circulation effect, the skeleton 10 and the hollow assembly 12 are connected (whereas, they are not connected in the second and third embodiment). Referring to FIG. 7, it can be clearly understood that the baffles 120 are all built on the skeleton 10, enabling the cooling spaces 122 among the baffles 120 to connect with an indoor space. Therefore, when indoor hot air rises up, the hot air will enter into the cooling spaces 122 directly, and then indoor temperature will be reduced by natural air circulation. It is worth of mentioning that when sun irradiates stronger, the heat convection of air will be more explicit and the rate of air circulation will be higher. In other words, the hotter the weather is, the better the indoor air circulation effect will be. Therefore, the indoor air can be circulated by a natural energy source, without using electricity to dissipate heat.

Figure 6:
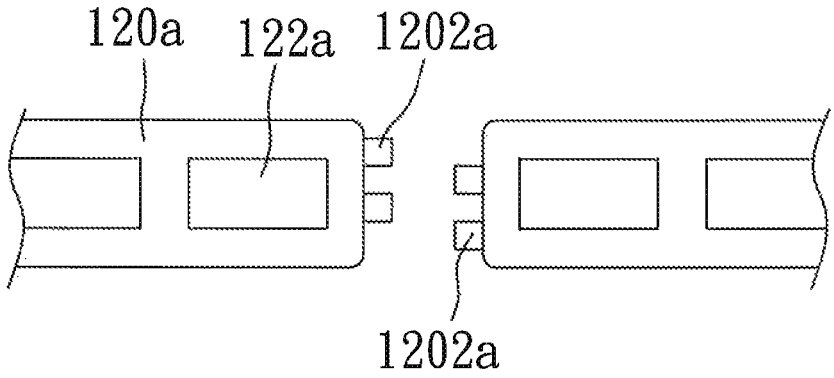
FIG. 6 shows a schematic view of a connecting structure of each brick.

Besides that, FIG. 6 discloses clearly the connection among the bricks. Herein, a hollow brick 120*a* with plural cooling spaces 122*a* is used as an example. In order to fix the hollow bricks 120*a* together, a side of each hollow brick 120*a* is formed with a connecting unit 1202*a* to combine and fix with the connecting unit 1202*a* on the other hollow brick 120*a*. Therefore, this can facilitate fixing upon assembling the hollow bricks 120*a*, and the hollow bricks 120*a* can be positioned, as well.

Accordingly, following functions can be acquired from the abovementioned structures:

1. The effect of natural air circulation can be utilized to reduce temperature of the air permeation roof.
2. As there is no need to use the external fans or air drafting equipment, it is not necessary to maintain the external fans or air drafting equipment constantly, thereby reducing the cost of related equipment.

3. As indoor temperature is reduced using the effect of natural air circulation provided by the hollow assembly, the green building concept that saves energy and reduces $CO_2$ emission is complied with, thereby improving the living quality of building.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A building roof structure comprising:

a skeleton, the skeleton is built on a top of the building;

a hollow assembly, the hollow assembly is installed on the skeleton;

a waterproof layer, the waterproof layer is paved on the hollow assembly wherein the hollow assembly includes a plurality of cooling spaces with the height of each space extending substantially from said skeleton directly to said waterproof layer; and a heat insulation plate, the heat insulation plate is disposed above the waterproof layer.

2. The building roof structure according to claim 1, wherein the hollow assembly is formed by plural baffles and the baffles form said cooling spaces for air circulation.

3. The building roof structure according to claim 1, wherein the hollow assembly is formed by plural hollow bricks with a cooling space and the hollow bricks are arranged beneath the waterproof layer in an array.

4. The building roof structure according to claim 1, wherein the hollow assembly is formed by plural long hollow bricks with a cooling space and the long hollow bricks are arranged side-by-side beneath the waterproof layer.

5. The building roof structure according to claim 3 wherein each hollow brick is provided with at least one connecting unit, whereby each hollow brick is formed with the connecting unit to combine and fix with another hollow brick.

6. The building roof structure according to claim 2, further comprising plural isolation nets, and the isolation nets are installed adjacent to the cooling spaces of each of the baffles respectively.

7. The building roof structure according to claim 3, further comprising plural isolation nets, and the isolation nets are installed adjacent to the cooling spaces of each of the hollow bricks respectively.

8. The building roof structure according to claim 4, further comprising plural isolation nets, and the isolation nets are installed adjacent to the cooling spaces of each of the long hollow bricks respectively.

9. The building roof structure according to claim 1, wherein a tail end of the heat insulation plate is installed with a flow deflector for guiding out rain water.

10. The building roof structure according to claim 8, wherein the flow deflector is provided with plural drain holes.

11. The building roof structure according to claim 9, wherein the skeleton is installed with a collecting trough that corresponds to the flow deflector and collects the rain water.

12. The building roof structure according to claim 9, further including plural illuminating lamps that are installed at a tail end of the flow deflector.

13. The building roof structure according to claim 1, further including a ridge at a center of the heat insulation plate, and the ridge is installed with a water sprinkler for sprinkling the heat insulation plate to reduce temperature thereof.

* * * * *